US005327842A

United States Patent [19]

Bailey

[11] Patent Number: 5,327,842

[45] Date of Patent: Jul. 12, 1994

[54] SAIL CONTROL SYSTEM

[76] Inventor: Richard B. Bailey, 330 NW. 22nd Ave., P.O. Box 1153, Camas, Wash. 98607

[21] Appl. No.: 76,920

[22] Filed: Jun. 14, 1993

[51] Int. Cl.[5] ..... B63H 9/10

[52] U.S. Cl. ..... 114/105

[58] Field of Search ..... 114/102-105

[56] References Cited

U.S. PATENT DOCUMENTS

| | | | |
|---|---|---|---|
| 4,354,444 | 10/1982 | Puretic | 114/105 |
| 4,688,506 | 8/1987 | Van Breems | 114/104 |
| 4,741,281 | 5/1988 | Doyle | 114/102 |
| 4,745,871 | 5/1988 | Wieder | 114/102 |
| 4,864,952 | 9/1989 | Stevenson | 114/102 |
| 5,048,443 | 9/1991 | Brown | 114/104 |
| 5,119,750 | 6/1992 | Somers | 114/104 |

FOREIGN PATENT DOCUMENTS

| | | | |
|---|---|---|---|
| 2674816 | 10/1992 | France | 114/103 |

OTHER PUBLICATIONS

Gerr, Dave, "Simplify Your Sail Handling"-Cruising World, Jan. 1987, pp. 33, 34, 37.

Harken 1992 Catalog-p. 150-Lazy Jacks.

Bennet, Deborah, "Three Ways to Tame Your Main"--Practical Sailor, Jan. 15, 1991, pp. 9-11.

*Primary Examiner*—Sherman Basinger

[57] ABSTRACT

A device for keeping a lowered sail on the boom, preventing it from falling to the deck, the device being so constructed that it can be deployed for use when lowering the sail, and retracted to lie along the boom when sailing or when the sail cover is to be applied. The retractability of the device is achieved by precise determination of lengths of sail restraining lines, and choice of their points of attachment to the boom, so that they lie along the boom when in the retracted position, without coming in contact with the sail.

20 Claims, 9 Drawing Sheets

14
50
58
18
34
10
44
34
22
40
26
48
30
30
52
16
36a
36b
36c
36d
54
56

14
50
58
18
34
10
44
48
26
30
52
16
36b
36c
36d
54
56

14
50
58
18
34
10
44
30
52
16
36c
36d
54
56

SAIL CONTROL SYSTEM

BACKGROUND

1. Field of the Invention

This invention relates to a system for controlling a boat sail during and after lowering the sail.

2. Discussion of Prior Art

In most modern pleasure sailboats, the mainsail is right triangular in shape and is supported by the mainmast. The sail is usually slidably attached to the mast by slides or slugs riding along a mating track or groove on the aft side of the mast. The slides or slugs are attached at intervals along the forward edge, or luff, of the sail. The bottom edge, or foot, of the sail is similarly attached to the boom, usually with slugs riding along a mating groove in the top of the boom. The boom is pivotably attached to the mast by a hinge device, or gooseneck. The boom is supported by a line, or topping lift, from the top of the mast to the aft end of the boom.

The mainsail is held in position up the mast more or less tightly with tension applied by a line, or halyard, attached to the top of the sail. The halyard extends up the mast, over a block, or pulley, at the top, and down to a convenient control point, where it is secured by a cleat or similar device. When it is desired to lower the sail, the halyard is freed from its cleat and the sail is allowed to slide down the mast of its own weight until it reaches the boom. At this point the sail is still held at its foot along the boom and at its luff by the sail track on the mast, where the slides or slugs are now resting on top of one another.

In the absence of a sail control device, the rest of the sail falls to the deck, draped from the boom, where it obscures the helmsperson's vision and also is an impediment to crew members needing to perform various tasks forward of the cockpit. Thus it is necessary for crew members to go forward immediately and fold or roll the sail onto the boom and secure it there with sail ties. This operation can take from 2 to 5 minutes, depending on wind and water conditions, and number of crew members available. It is obviously much more difficult in rough water or if the boat is being sailed single-handed or with an insufficient or inexperienced crew. During this time the helmsperson must steer with limited vision, which is particularly dangerous in crowded waters. Alternatively, a single-hander must stop and furl the sail before continuing.

Lazy Jacks

One of the earliest ways of solving this problem was by the use of lazy jacks, usually consisting of one or more pairs of lines extending from each side of the mast down to the corresponding sides of the boom. The ends of these lines are fastened at intervals along the boom away from the mast, with the sail in between them. As currently manufactured and sold, these consist of either two or three lines on each side of the boom. Thus, when the sail is lowered, it is trapped between the lines and is at least partially restrained from falling to the deck. Lazy jacks as currently sold suffer from three major disadvantages:

(a) Being permanently fastened high on the mast, they cannot be retracted while sailing. They are apt to chafe the mainsail, particularly the sewing threads, which protrude out of the sail cloth. This abrasion may cause the seam to fail.

(b) A furled sail is normally protected from the sun's rays by a cover. Special slots or zippers must be added to the sail cover to accommodate the lazy jack lines which are attached to the boom.

(c) Two lines on each side of the boom do not give adequate control of unbattened or short-battened sails, especially with the long booms on larger boats. Threeline systems are expensive.

U.S. Pat. No. 4,280,431 to Sofen (1981) discloses a device comprising several removable flexible support members which are disposed along the boom to catch and hold the sail. Each support member clamps onto the boom independently, the plurality forming a sail catching receptacle. Each support member can then be flexed around the lowered sail and the opposite ends fastened together to retain the sail. This system requires the flexible support members to fit closely around the boom so as to clamp themselves onto it. Since booms vary widely in cross-section, a different size or shape would be required for each boom. Further, the mainsail on a large boat is heavy and might knock the support members off the boom as the sail dropped.

U.S. Pat. No. 4,688,506 to van Breems (1987) discloses a method for controlling sails by two or more lines threaded back and forth through vertically aligned grommets in the sail, thus causing it to fold back and forth, or flake, while holding it on the boom, as it is being lowered. This device is sold commercially under the tradename "Dutchman". It is an integral part of the sail, so must be constructed or retrofitted by a sailmaker. It is used primarily on full batten sails. It requires modification of the sail cover, and a special topping lift. Because of its complexity, it is considerably more expensive than a lazy jack.

U.S. Pat. No. 5,048,443 to Brown (1991) discloses a method similar to that of van Breems. Interwoven through grommets on the sail are two or more lines, one of which is a shock cord, or elastic line. The sail is hauled down with a special line, rather than sliding down of its own weight. This system is also integral with the sail so must be constructed by a sailmaker.

U.S. PAT. Nos. 4,354,444 to Puretic (1982), 4,741,281 to Doyle (1988) and 4,745,871 to Wieder (1988) disclose systems which combine the properties of sail cover and sail control device. Doyle combines a conventional lazy jack with his sail cover system. Puretic's system consists of two triangular cloth panels attached to mast and boom to form a pocket to catch the sail. He uses no lines to guide the sail into the pocket. Wieder's system embodies a similar pocket, the sides of which are supported by lines attached high on the mast and serving as lazy Jacks to guide the sail into the pocket. The lazy jacks in these systems have the same disadvantages as ordinary lazy jacks, discussed above. Also, attachments to the boom may interfere with reefing lines.

U.S. Pat. Nos. 4,986,205 (1991) and 5,119,750 (1992) to Somers disclose a sail dousing and flaking system and an improvement thereto. It comprises multiple luff shackles which turn alternately in opposite directions as the sail is lowered, flaking the sail to right and left. Additionally, it incorporates matching flaking devices along the leech activated by a douser line, which assists the flaking action of the luff shackles. The system requires modifications to the sail, as well as special hardware.

U.S. Pat. No. 4,864,952 to Stevenson (1989) discloses a flaking system comprising a brailing line connecting the leech of the sail to the topping lift at multiple points along its length. It requires a number of special blocks riding on the topping lift, as well as grommets set into the leech of the sail.

Several U.S. Pat. Nos. [4,347,799 to Moriarty (1982); 4,844,136 to Vavlitis (1989); 4,895,092 to Schmeising (1990); and 5,076,187 to Robinson (1991)] disclose systems comprising various structures attached to the boom at two or more points in its length. These structures serve to hold foldable or insertable rigid elements, extending out from the boom on each side at an upward angle, to support the sail on the boom. The Schmeising system is sold by mail order under the name "Maintamer". Such systems clutter the boom, and may interfere with reefing lines, sail ties, and sail cover. The insertable type would be very difficult to use in rough water. Further, the sail would require tieing immediately after lowering. Otherwise a gust of wind could blow it out of the supporting structure and onto the deck, possibly resulting in damage as it draped over the ends of the rigid elements.

SUMMARY OF PRIOR ART

From the above, it will be seen that previous efforts to solve the sail control problem have resulted in a variety of solutions. Some of these are commercially successful, but taken as a group there are a number of disadvantages which no one of them completely overcomes:

(a) Chafing of the sail;
(b) Relatively high cost;
(c) Need for specialized parts, blocks, castings, etc.;
(d) Lack of simplicity and difficulty of repair;
(e) Need for alteration of sail cover on retrofits;
(f) Need for professional help, as for alteration of sail, to construct and install;
(g) Inability to control sail against blowing if not tied;
(h) Inability to operate sail control system from cockpit.

OBJECTS AND ADVANTAGES

Accordingly, several objects and advantages of my sail control system are:

(a) to provide a system which will efficiently control a sail as it is being lowered;
(b) to provide a sail control system which will restrain the sail, without tieing, for short periods of time;
(c) to provide a sail control system which will not cause chafing of the sail while sailing;
(d) to provide a sail control system which will retract out of the way when not being used;
(e) to provide a sail control system which will fit under an existing unaltered sail cover;
(f) to provide a sail control system which can be operated from the cockpit;
(g) to provide a sail control system which can be installed by the boat's owner without professional help;
(h) to provide a sail control system which can be installed on an existing boat without modifying the sail.
(i) to provide a sail control system which can be used on either main or mizzen sails.
(j) to provide a sail control system which will not interfere with the reefing system.

Further objects and advantages are to provide a sail control system which is inexpensive and which can be repaired easily by a crew member without special tools or supplies. Still further objects and advantages will become apparent from a consideration of the ensuing description and drawings.

LIST OF REFERENCE NUMERALS

Figure 1:
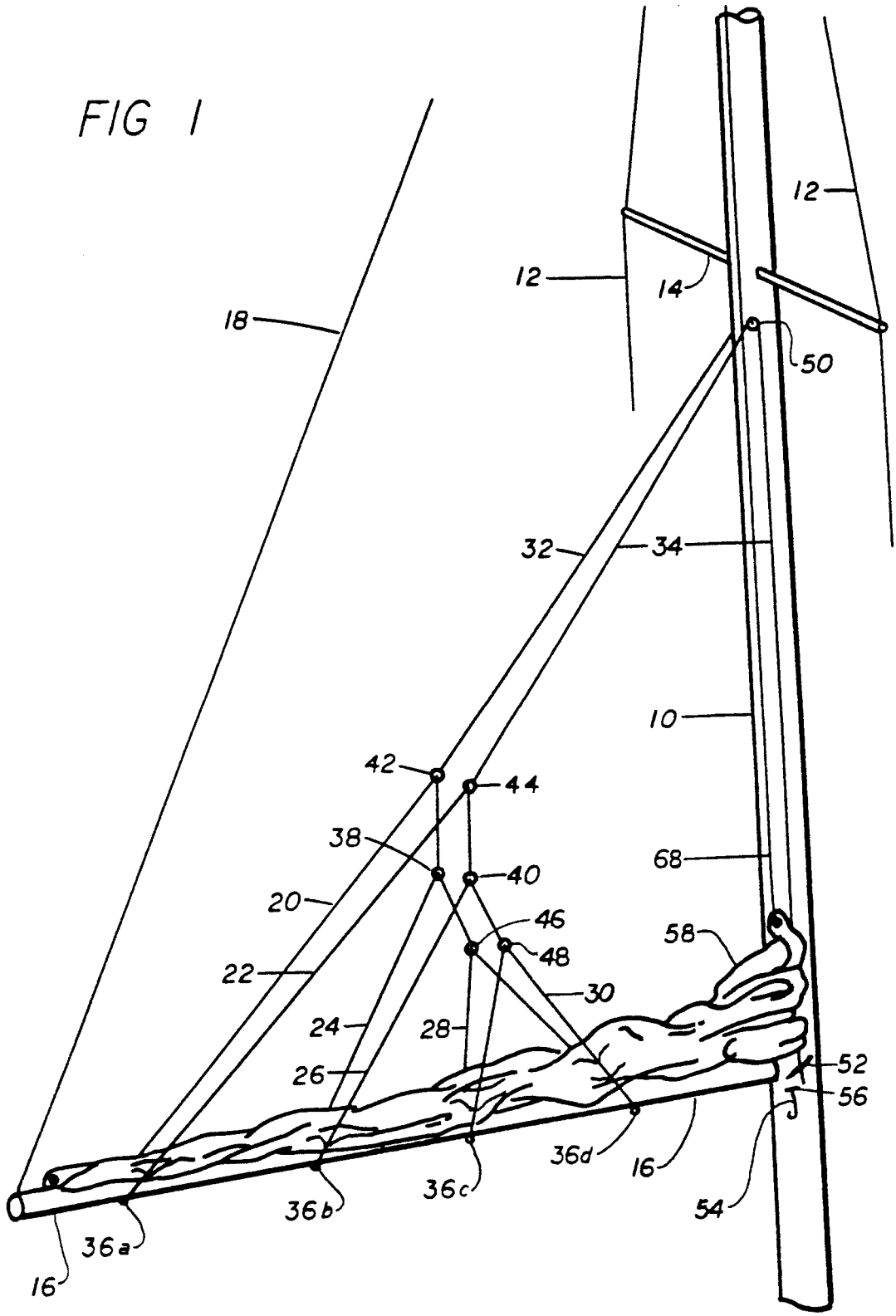
FIG. 1 is an isometric drawing of my sail control system deployed for use, with sail down but not tied.

10 mast
12 stays
14 spreaders
16 boom
18 topping lift
20, 22, 24, 26, 28, 30 sail restraining lines
32, 34 system control lines
**36*a*, 36*b*, 36*c*, 36*d*** eyestraps
38, 40, 42, 44, 46, 48 sliding contact means, or rings
50 cheek block
52 cleat for system control line
54 shock cord or keeper
56 keeper eyestrap
58 sail
60 system retracting line
62 fairlead for system retracting line
64, 66 blocks at bottom of mast
68 halyard
70 cleats for cockpit control
72 cockpit
74 sail ties
76 pulleys attached to spreaders
78 pulley as sliding contact means
80 eye with thimble as sliding contact means
82 thimble

DESCRIPTION OF INVENTION

Deployed Position

FIG. 1 is an isometric drawing of the preferred embodiment of my sail control system installed on a sailboat. The components of the boat, not part of my system, include a mast 10 supported by stays, or shrouds 12, two of which are shown. Usually there are at least six others, none of which are shown. Four lower shrouds run from deck level to just below the spreaders 14, two on each side. A forestay and a backstay (not shown) give fore and aft stability to the top of the mast.

A boom 16 is pivotably fastened to the mast. The boom is supported by a topping lift 18 extending from the end of the boom to the top of the mast. The boom is controllably free to pivot back and forth on the mast as dictated by wind conditions. A sail 58 is slidably attached to the mast by slides (not shown) engaged with a mating track (not shown) on the aft side of the mast. The slides are attached at intervals along the forward edge, or luff, of the sail. The sail is raised or lowered by a halyard 68. The bottom edge, or foot, of the sail is similarly attached to the boom, by slugs (not shown) engaged with a mating groove in the top of the boom (not shown).

Figure 2:
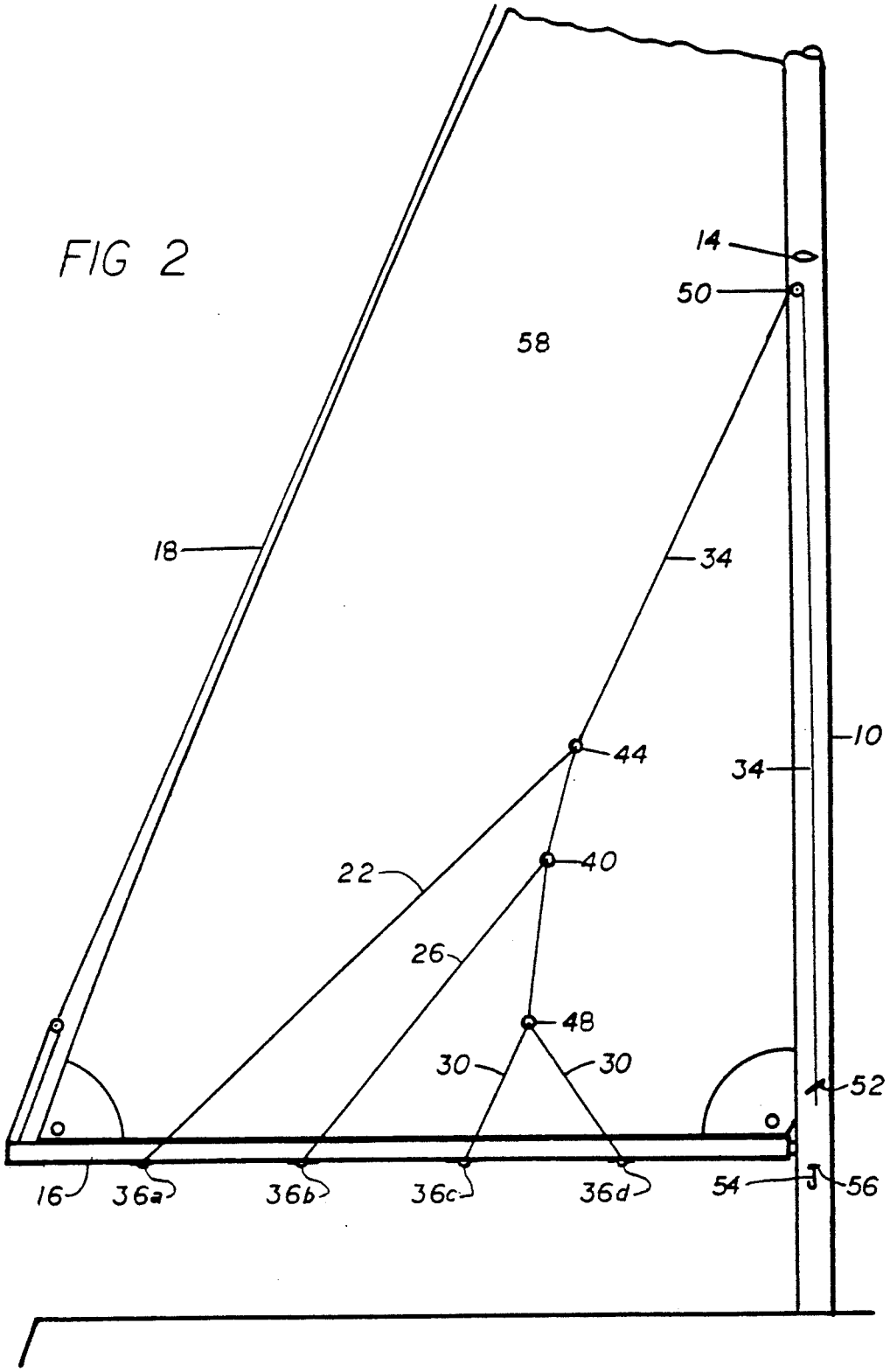
FIG. 2 is a starboard side view of my control system deployed for use, with sail up.
Figure 3:
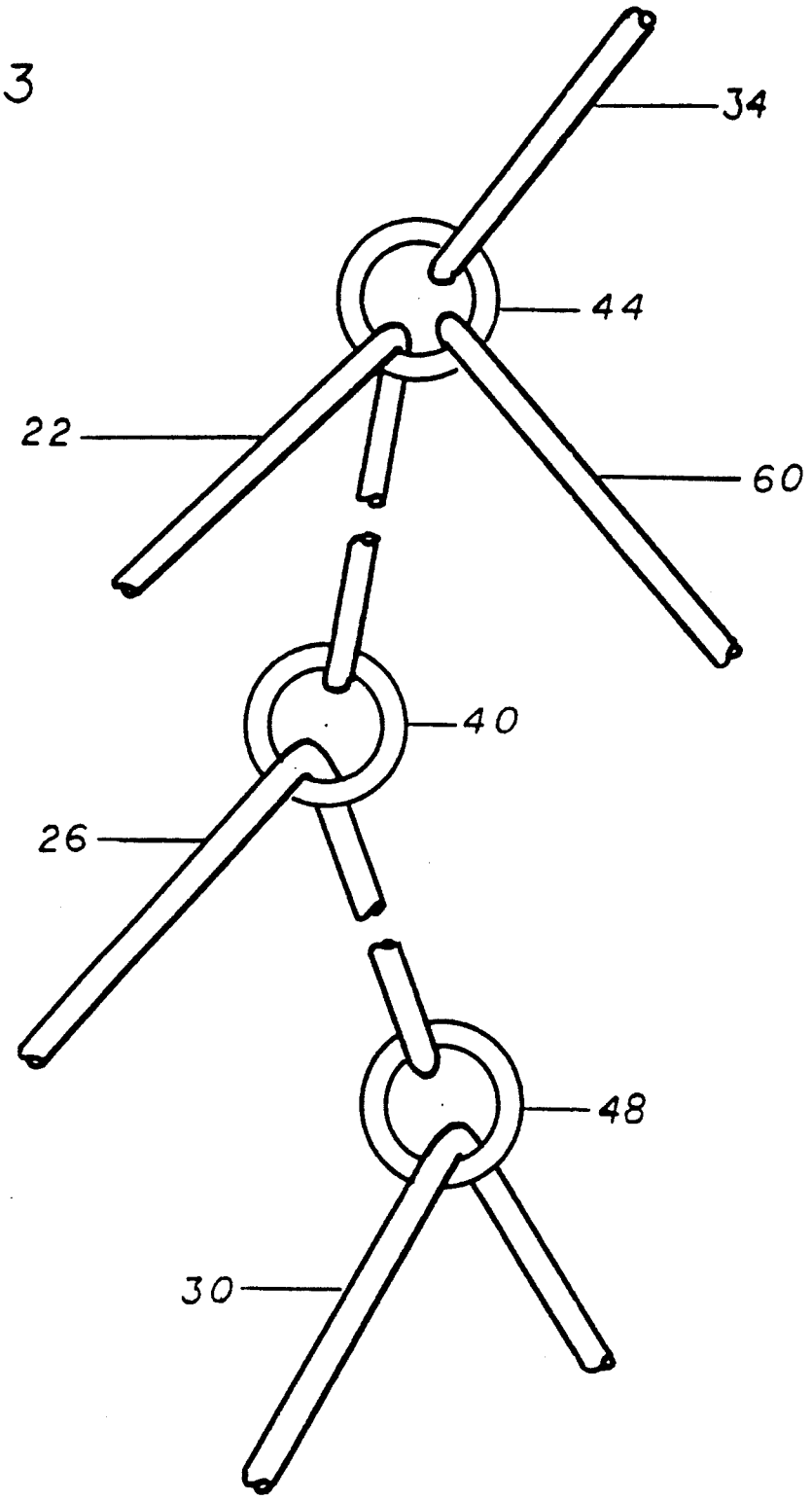
FIG. 3 shows assembly details of sail restraining lines and system control lines.

FIG. 1 shows my sail control system in raised or deployed position with sail lowered but not tied. FIG. 2 shows the starboard side of my system, also in raised or deployed position, but with the sail up. For FIGS. 2–6, it will be understood that while, for simplicity, only one side of the system is shown and discussed, the comments apply equally to the concealed side. FIG. 3 shows details of the method of attachment of sail restraining lines and system control lines to each other.

The sail restraining lines 20, 22, 24, 26, 28, and 30 are slidably held under tension in deployed position by system control lines 32 and 34. The sail restraining lines are arranged in pairs, each attached to the boom. Lines 20 and 22 form a pair. Line 20 is attached on the port side of the boom and line 22 is attached on the starboard side. Attachment to the boom can be in any suitable manner. In the preferred embodiment of my system, eyesplices on the ends of sail restraining lines 20, 22, 24, 26, 28, and 30 are secured with eyestraps 36*a*, 36*b*, 36*c*, and 36*d* attached to the bottom of the boom. Each eyestrap holds both port and starboard lines. Thus lines 20 and 22 are attached to the boom by eyestrap 36*a*.

To the opposite, or unattached, ends of lines 20 and 22 are fastened stainless steel rings 38 and 40. These rings serve to support the adjacent pair of sail restraining lines 24 and 26. Support is accomplished by arranging lines 24 and 26 to pass through rings 38 and 40. The first pair of sail restraining lines 20 and 22 are thus slidably supporting the second pair of lines 24 and 26 with rings 38 and 40. The first pair of lines 20 and 22 are themselves arranged to pass through and are supported by rings 42 and 44, which are attached to system control lines 32 and 34, as described below.

The second pair of sail restraining lines, 24 and 26, are attached to the boom in like manner by eyestrap 36*b*. Also like the first pair, 20 and 22, they are attached at their opposite ends to rings 46 and 48. Rings 46 and 48 slidably support the third pair of sail restraining lines 28 and 30 in like manner. The third pair of lines, 28 and 30, differ from the first two pair in their method of attachment. Both ends of lines 28 and 30 are attached to the boom in the manner already described.

Summarizing the above, system control lines 32 and 34 and their rings 42 and 44 slidably support the first pair of sail restraining lines 20 and 22. In turn, the first pair of sail restraining lines 20 and 22 and their rings 38 and 40 slidably support the second pair of sail restraining lines 24 and 26.

Figure 3A:
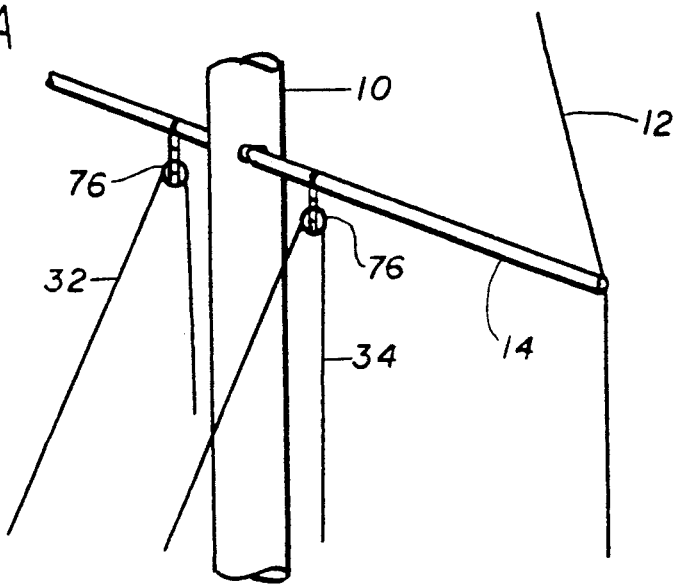
FIG. 3A shows pulleys attached to spreaders in lieu of cheek blocks on mast.

Again in turn, the second pair 24 and 26 and their rings 46 and 48 slidably support the third pair of lines 28 and 30. The system control lines 32 and 34 extend upward from rings 42 and 44 to cheek block 50 and its mate (not shown), located on the mast. FIG. 1 shows the preferred embodiment of my system, with the blocks located just below the spreaders. It would be obvious to one skilled in the art that the exact position of the blocks on the mast is not critical. It would also be obvious that if the blocks are located below about one-fourth of the height of the mast, the angle of pull on the sail restraining lines would be too flat to permit good leverage, and that if higher than about three-fourths of the mast's height, the control line would become too long and combersome. Alternatively, pulleys 76 may be attached to the spreaders 14 as in FIG. 3A, or the rigging (not shown). From the blocks, the system control lines extend down the mast to cleat 52 and its mate (not shown), located at a convenient position, for example on the mast.

Sail restraining and system control lines may be constructed of any suitable material, for example nylon, polyester, or other flexible materials. The lines may be of any suitable construction, for example, either 3-strand or braided. They may be of any convenient diameter affording strength, flexibility and ease of handling. To those skilled in the art it will be obvious that a greater or lesser number of sail restraining lines could be used. For example, a short boom might require only two or even one pair of such lines. A much longer boom might require more than three.

Figure 7:
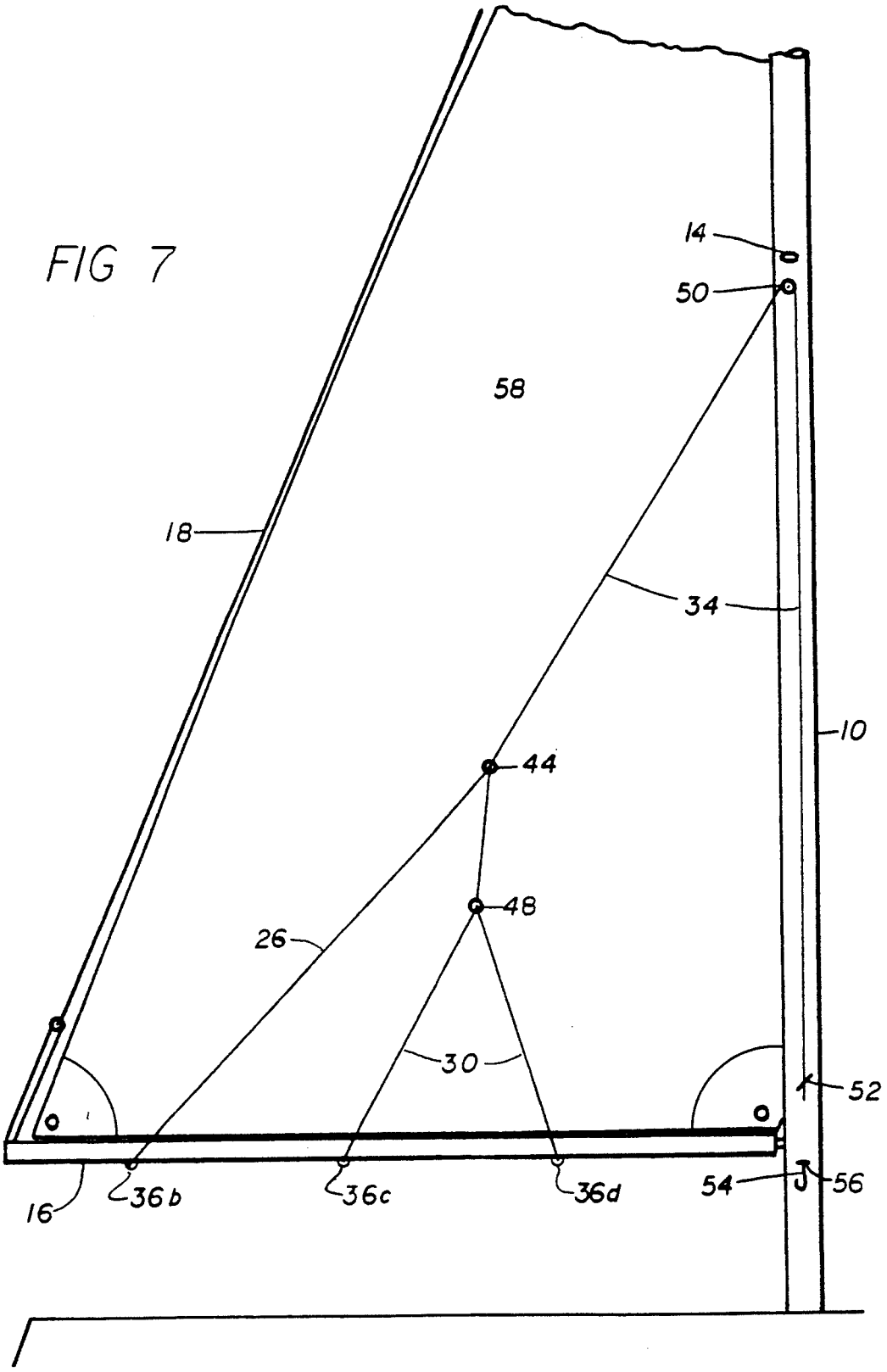
FIG. 7 shows starboard view of embodiment of my sail control system with two restraining lines.

FIG. 7 illustrates the embodiment of may system for use on a boom of intermediate length, in which sail restraining lines 20 and 22 have been omitted, leaving two pair of lines, 24 and 26, and 28 and 30. System control lines 32 and 34 are slidably attached to the aftermost pair 24 and 26 of the two remaining pair of sail restraining lines.

Figure 8:
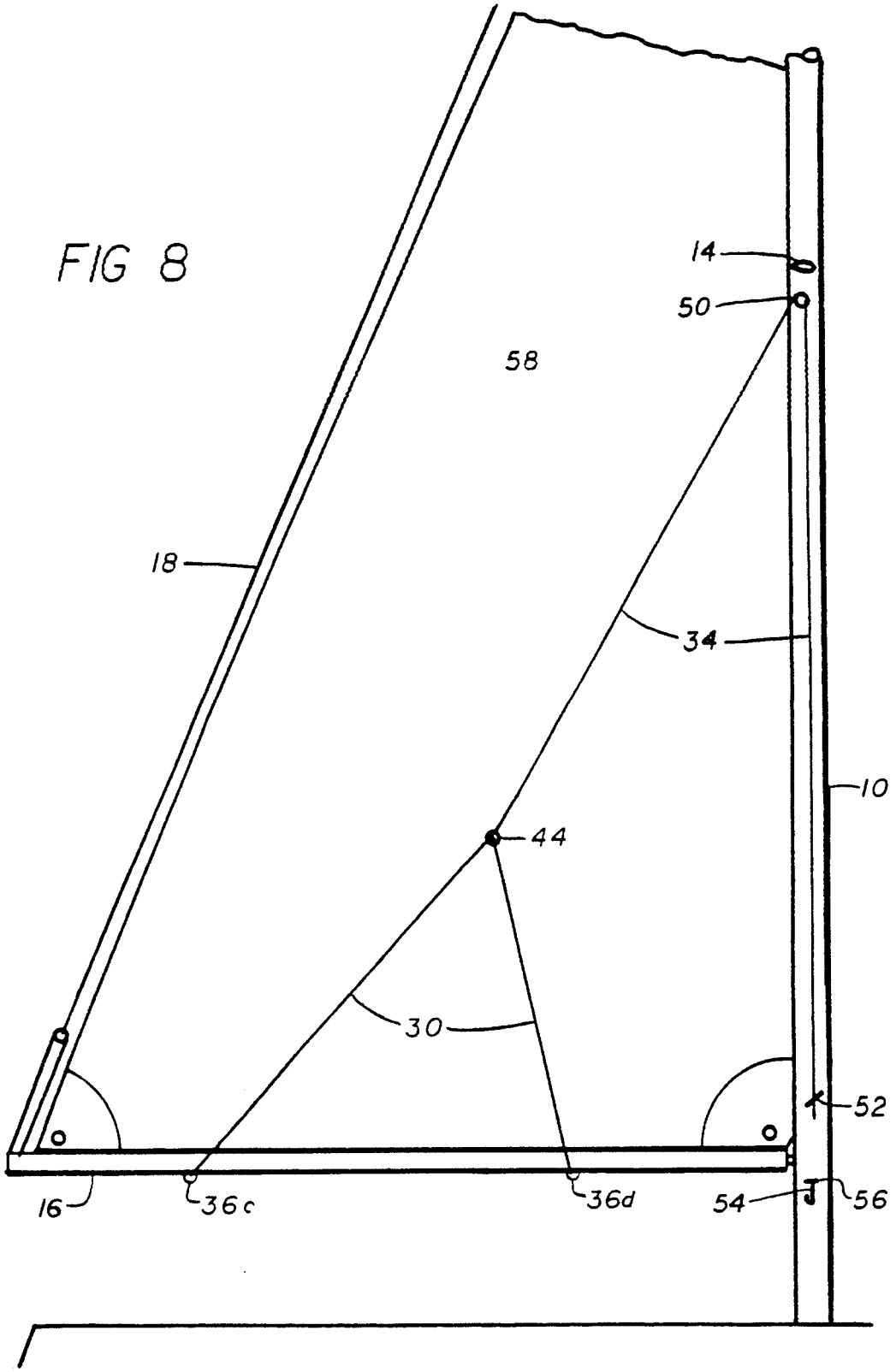
FIG. 8 shows starboard view of embodiment of my sail control system with one restraining line.

FIG. 8 illustrates the embodiment of my system for use on a short boom, in which all but the forwardmost pair 28 and 30 of sail restraining lines have been omitted. The system control lines 32 and 34 are slidably attached directly to the forwardmost lines 28 and 30.

Figure 3B:
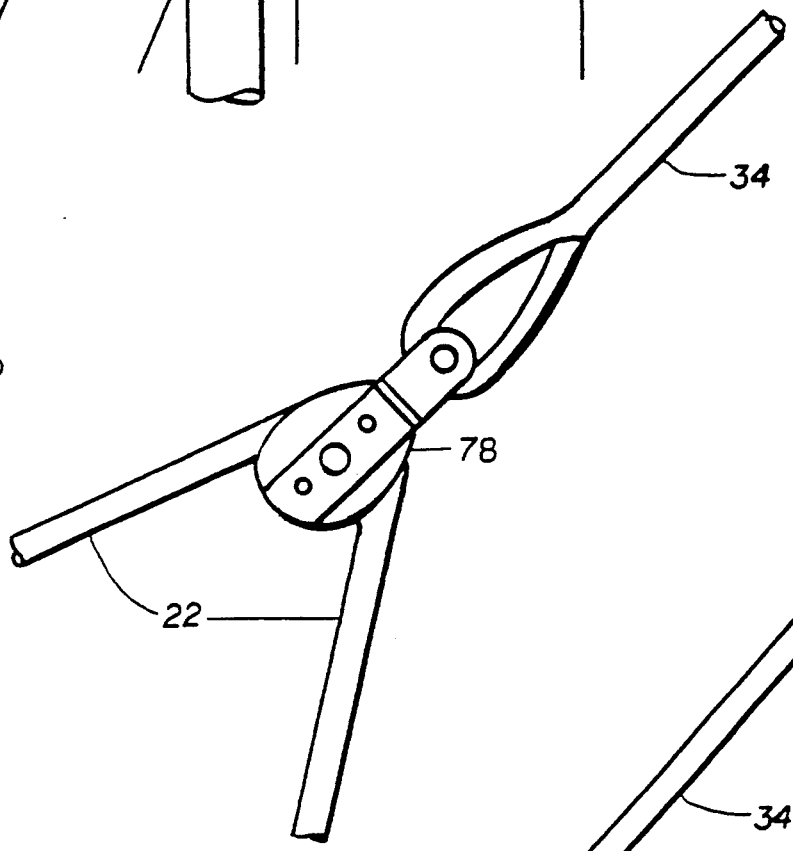
FIG. 3B shows use of pulley as sliding contact means.
Figure 3C:
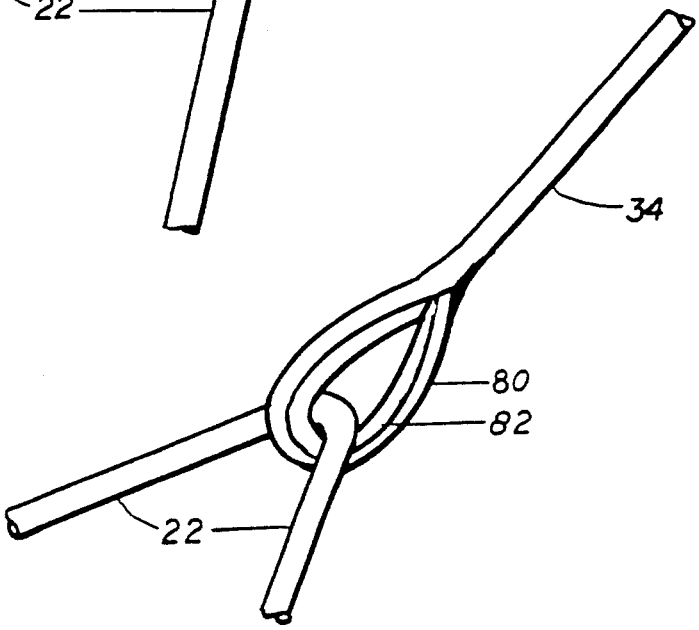
FIG. 3C shows use of eye with thimble inserted as sliding contact means.

It would also be obvious that blocks, or loops or eyes in the end of the lines, with thimbles inserted, could be substituted for the rings, as shown in FIG. 3B and FIG. 3C. It would also be obvious that system control lines 32 and 34 could be run through suitable fairleads to some other control point, for example the cockpit of a sailing vessel, as in FIG. 4.

Cockpit Control

Figure 4:
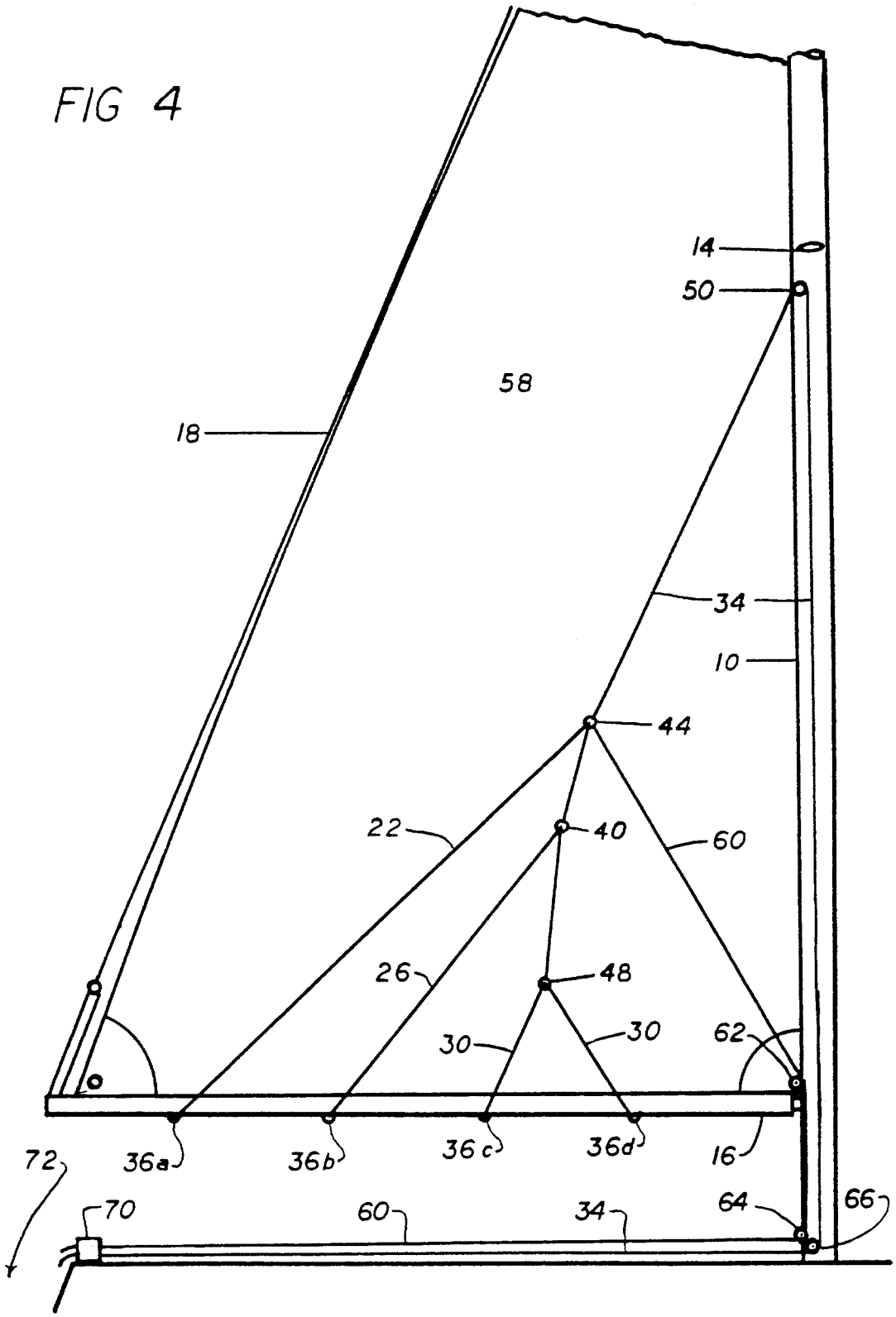
FIG. 4 shows my sail control system with system retracting lines and system control lines led to the cockpit.

FIG. 4 shows my sail control system rigged for cockpit control. In this embodiment, a system retracting line 60 has been added, attached to ring 44. It extends diagonally downward to the mast at boom level, where it is guided by a suitable fairlead 62 down the mast to the base of the mast. The system control line cleat 52 of FIG. 1 is eliminated and instead the system control line 34 extends down the mast to the base of the mast. Fairleads 64 and 66 at the bottom of the mast allow the lines to be extended aft to the cockpit to cleats 70, to form a cockpit control point.

Retracted and Stowed Position

Figure 5:
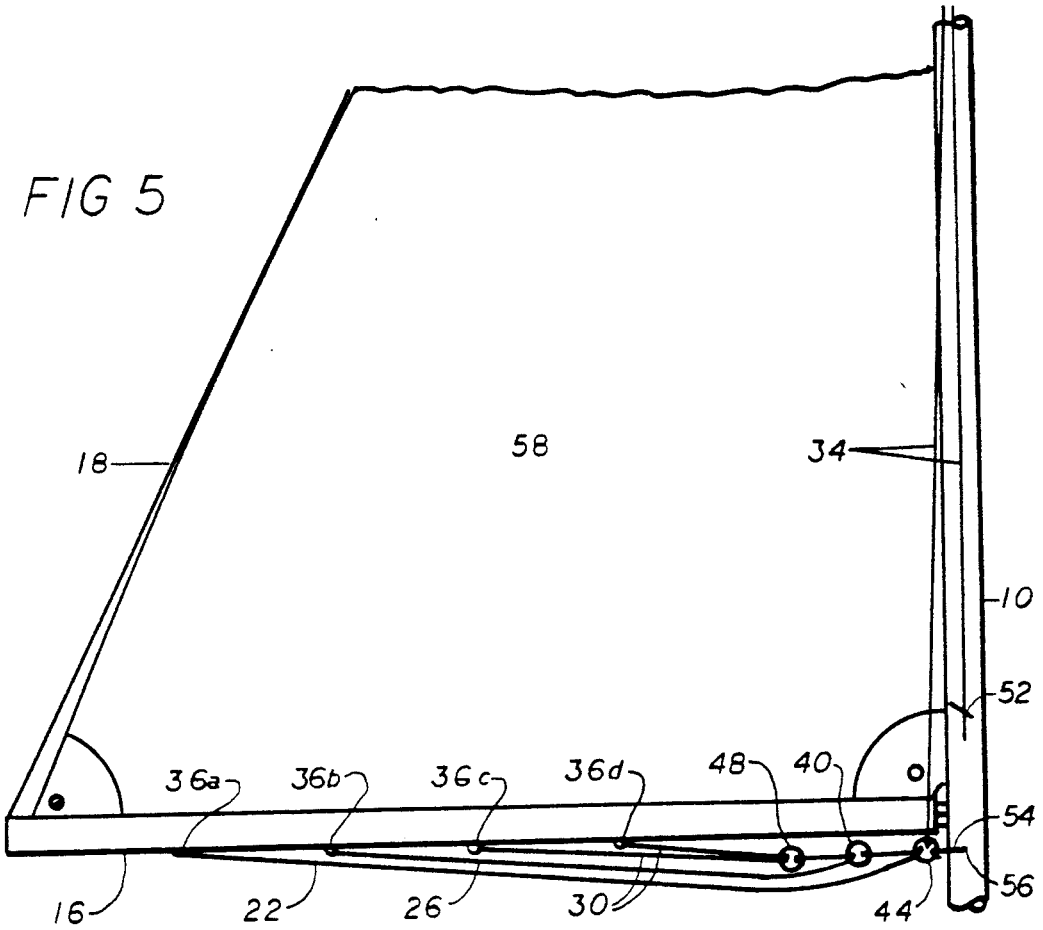
FIG. 5 is a starboard side view of my control system in retracted and stowed position with sail up.
Figure 5A:
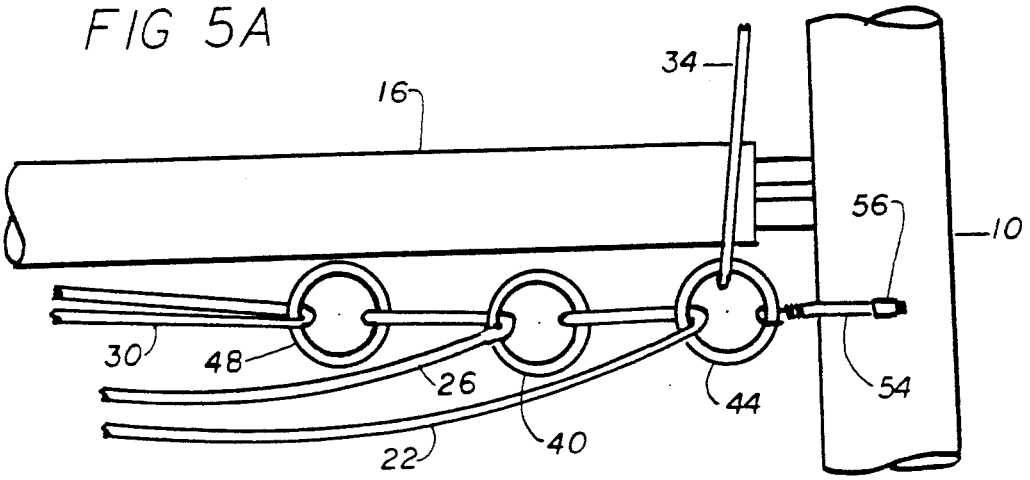
FIG. 5A shows details of my sail control system in retracted and stowed position.
Figure 6:
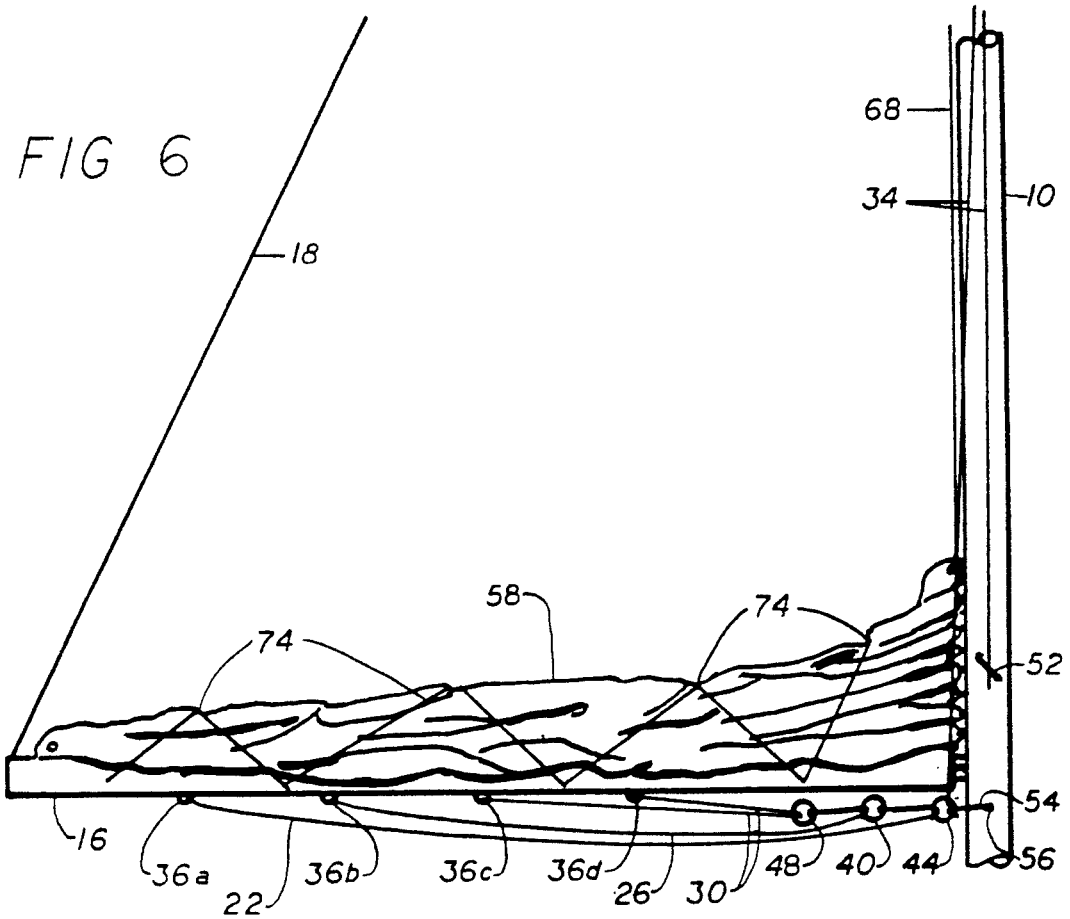
FIG. 6 shows the system in retracted and stowed position with sail down and tied.

FIGS. 5, 5A, and 6 show the starboard side of the preferred embodiment of my sail control system in retracted and stowed position. In these figures, the sail restraining lines are shown as being slack to achieve clarity of portrayal. In actuality they would be held snugly along the bottom of the boom by the tension of the keeper 54.

Herein lies the heart of my sail control system. In this retracted and stowed position, system control line 34 has been released from cleat 52 and the sail restraining lines 22, 26, and 30 have been allowed to drop down to boom level. The system control line 34 and its ring 44 are held under tension by a shock cord and hook arrangement 54, or keeper, attached to the mast 10 by an eyestrap 56. Ring 44 is even with the forward end of the boom. Ring 44, under tension from the keeper 54, in turn holds ring 40 and sail restraining line 26 in tension. Ring 40, again in turn, holds ring 48 and sail restraining line 30 in tension. Thus, together, the sail restraining lines are held taut along the bottom of the boom from tension supplied by the keeper 54.

From the foregoing description, it becomes obvious that the lengths of sail restraining lines 20, 22, 24, 26, 28, and 30 are critical if the rings are to line up as in FIGS. 5, 5A, and 6. For example, if restraining line 22 is too long, ring 44 may extend to the mast, so that the keeper 54 cannot apply enough tension to keep the lines taut. If line 22 is too short, ring 44 will be farther from the mast, and may bear against ring 40 before the system is completely retracted. Again, if line 26 is too long, ring 40 will be closer to the mast, and may bear against ring 44 before the lines are taut. It will be obvious to one skilled in the art that some minimum spacing between rings, at least an inch, must be maintained to prevent their bearing against each other. If line 26 is too short, ring 40 Will be farther from the mast, and may bear against ring 48 before the lines are taut. Thus, for the system to retract and stow properly, it is essential to determine accurately the lengths of sail restraining lines.

Determination of Line Lengths

In the preferred embodiment of my sail control system, when in the retracted position, it is desired to have ring 44 approximately even with the forward end of the boom. It is further desired to have the other rings, 40 and 48, spaced at roughly six to twelve inch intervals in an aft direction along the boom. Such spacing allows the sail restraining lines to be as long as possible in order to give maximum support to the lowered sail on the boom, while still providing retractability, which is the essence of my sail control system. It will be obvious to one skilled in the art that as the spacing between rings increases, the length of effective sail restraining line decreases, and that a practical maximum distance would certainly not exceed about 24 inches.

For simplicity of explanation, the rings on only one side of the boom are shown, it being understood that the discussion applies equally to those on the other side. Generally, the positions of the eyestraps securing the sail restraining lines will be determined first, according to boom length and position of other objects already attached to the boom. Line lengths may then be determined by well-known graphical or mathematical methods. For example, one empirical method is described below.

Sail restraining line 22. Measure from the centerline of desired position of eyestrap 36*a* to forward end of boom 16 and add desired distance between rings, center to center. For example if eyestrap 36*a* is 144 inches from the forward end of boom 16, and desired distance between centerline of rings is 7 inches, line 22 should be $144+7=151$ inches long.

Sail restraining line 26. Measure from the centerline of eyestrap 36*b* to forward end of boom 16. For example if eyestrap 36*b* is 108 inches from end of the boom, line 26 should be 108 inches long.

Restraining line 30 Measure from the centerline of eyestrap 36*c* to forward end of boom 16. Measure from the centerline of eyestrap 36*d* to forward end of boom. Add together and subtract four times the desired center to center spacing between rings. For example, if eyestraps 36*c* and 36*d* are 72 inches and 36 inches, respectively, from end of boom 16, and desired spacing between rings is 7 inches, line 30 should be $72+36-28=80$ inches.

OPERATION OF INVENTION

The operation of my sail handling system involves these steps:

(a) A sailboat under sail would have my system in retracted and stowed position, as in FIG. 5, in order to prevent chafing of the sail. The first step would be to unhook rings 42 and 44 from their keeper hooks 54 and its mate (not shown).

(b) Before lowering the sail 58, my system would be raised by hauling in on system control lines 32 and 34, which in turn would raise the interconnected rings and sail restraining lines to the deployed position. Control lines 32 and 34 would be cleated off. The boat would be headed into the wind with the sail luffing (fluttering).

(c) The sail 58 would be lowered to the boom 16, where it would be retained by the deployed system, as in FIG. 1. The boat would proceed to its slip and tie up.

(d) The sail would be secured with sail ties 74. The sail control system would be lowered by releasing the system control lines 32 and 34 from their cleats. It would be retracted and stowed by hooking rings 42 and 44 onto keeper 54 and its mate as in FIG. 6, before putting on the sail cover.

Operation of Cockpit Control

For clarity, only one side of the system is discussed here, but it will be understood that these comments apply to the opposite side as well. When sailing, a boat would normally have my sail control system in retracted and stowed position to avoid sail chafing, as in FIG. 5, with system retracting line 60 pulled tight and cleated at the cockpit. Also, system control line 34 would be loosely cleated at the cockpit.

Before lowering the sail 58, the system retracting line 60 would be uncleated and the system control line 34 would be hauled tight and cleated, thus deploying the system in raised position ready to receive the sail, as in FIG. 2. The sail would then be lowered as in FIG. 1. When convenient, the sail would be secured with sail ties 74. The system control line 34 would then be uncleated while system retracting line 60 was being hauled tight and cleated to return the system to its retracted and stowed position as in FIG. 6, preparatory to installing the sail cover.

SUMMARY, RAMIFICATIONS, AND SCOPE

Accordingly, the reader will see:

that my sail control system can be used to control a mainsail or mizzen sail while it is being lowered, and prevent it from falling from the boom onto the deck;

that this system will serve to hold such a sail on the boom temporarily while the boat is being anchored or brought in to a slip;

that my sail control system is completely retractable below the boom;

that it cannot cause any chafing of the sail;

that it will not interfere with a reefing system;

that an existing sail cover will fit over it without alteration;

that it can be rigged for cockpit control;

and that the system can be easily installed on a boat without alteration of the sail or the sail cover.

Although the description above contains many specific examples, these should not be construed as limiting the scope of the invention. These are merely to provide illustrations of some of the presently preferred embodiments of this invention. For example, blocks (pulleys) could be substituted for the described rings; the pairs of sail restraining lines could be passed under the boom as one continuous line; or various numbers of pairs of sail restraining lines could be used.

Thus the scope of the invention should be determined by the appended claims and their legal equivalents, rather than by the examples given.

I claim:

1. A sail control system for use with a boat having a mast, a boom, and a sail slidably supported on said mast so that said sail can be lowered to rest on said boom, said sail control system being an improved lazy jack, intended to keep the lowered sail confined on the boom, and comprising, on each side of the boom:

a plurality of sail restraining lines of predetermined length, each attached to the boom at predetermined and separated points along its length, each designated according to its position along the boom with respect to the others, and each slidably attached to an adjacent sail restraining line;

a system control line fed through a block located above and substantially higher than the boom, with one end slidably attached to the aftermost of said sail restraining lines and the other end terminated at a suitable control point, said system control line being an adjusting means for placing the sail control system in raised or lowered position;

sliding contact means for slidably attaching the system control line to said aftermost sail restraining line, and for slidably attaching each successive one of the sail restraining lines to the next one forward, so as to form an interlinked sail control system; and a securing means for holding the sail restraining lines in the lowered position along the boom;

the predetermined lengths and attachment points of said sail restraining lines being such that when the lines are in a raised position, they confine the sail on the boom, and when they are in a lowered position, and stretched along the boom toward the mast, they do not reach the mast, so that the sail restraining lines in the lowered position can be extended toward the mast and held tautly along the boom by said securing means, wherein the improvement comprises the predetermined lengths of the sail restraining lines, and the selection of the points at which they are fastened to the boom, the system control line as adjusting means to place the sail control system in raised or lowered position, and the securing means to hold said sail control system secured along the boom, so that the sail control system can be quickly and easily adjusted to a raised or lowered position by means of the system control line, and the sail control system in the lowered position can be held along the boom, by said securing means, out of the way of the sail and without interfering with covering the sail.

2. The sail control system of claim 1 wherein the sliding contact means for slidably attaching the lines to each other are selected from the group consisting of rings, pulleys, or eyes formed in the end of the lines, with thimbles set therein, or combinations thereof.

3. The sail control system of claim 1 wherein the predetermined lengths of the sail restraining lines and their points of attachment to the boom are so regulated that when the sail control system is in the lowered position extended along the boom toward the mast, the sliding contact means linking the system together are grouped at the forward end of the boom, and separated from each other by approximately 1 inch to 24 inches.

4. The sail control system of claim 1 wherein the lines are selected from the group consisting of braided polyester, braided nylon, 3-strand polyester, and 3-strand nylon.

5. The sail control system of claim 1 wherein the block holding each system control line is a cheek block located on the mast at a point approximately one-fourth to three-fourths of its height.

6. The sail control system of claim 1 wherein the block holding each system control line is suspended from the spreader.

7. The sail control system of claim 1, further including extension to the cockpit of the boat of the system control line to afford control means from that point.

8. A sail control system for use with a boat having a mast, a boom, and a sail slidably supported on said mast so that said sail can be lowered to rest on said boom, said sail control system being an improved lazy jack, intended to keep the lowered sail confined on the boom, and comprising, on each side of the boom:

a first sail restraining line attached at each of its ends to separated points along the length of the boom, said first sail restraining line being of such predetermined length and having its points of attachment so located that when it is in a raised position it forms a restraining means for the lowered sail on the boom, and when it is in a lowered position and stretched out along the boom toward the mast, its bight cannot reach the mast;

a second sail restraining line, attached at one of its ends to a point on the boom farther from the mast than either attachment point of the first sail restraining line, and having at its other end a sliding contact means, said sliding contact means forming a slidable supporting link for the first sail restraining line, said second sail restraining line being of such predetermined length and having its points of attachment to the boom so located that when it is in a raised position, it forms a slidable supporting link for the first sail restraining line, and forms a restraining means to hold the lowered sail on the boom, and when it is in a lowered position and stretched out along the boom toward the mast, its bight falls between the bight of the first sail restraining line and the mast;

a third sail restraining line, attached at one of its ends to a point on the boom farther from the mast than the attachment point of the second sail restraining line, and having at its other end a sliding contact means, said sliding contact means forming a slidable supporting link for the second sail restraining line, said third sail restraining line being of such predetermined length and having its point of attachment to the boom so located that when it is in a raised position it is a slidable supporting link for the first and second sail restraining lines and forms a restraining means to hold the lowered sail on the boom, and when it is in a lowered position and stretched out along the boom toward the mast, its bight falls between the bight of the second sail restraining line and the mast;

a system control line having a sliding contact means at one of its ends, said sliding contact means forming a slidable supporting link for the third sail restraining line, said system control line itself being fed through and supported by a block attached at an elevated point above the boom, with the other end of the system control line terminated at a suitable control point; and a securing means for holding the sail restraining lines in the lowered position along the boom;

whereby the sail control system may be placed in a raised or lowered position by means of the system control line, and whereby the system control line in a raised position is a support means for the linked first, second and third sail restraining lines simultaneously to form a control system for the lowered sail, and whereby when the sail control system is in the lowered position, said sail restraining lines can be extended toward the mast and held tautly along the boom by said securing means, out of the way of the sail;

wherein the improvement comprises the predetermined lengths of the sail restraining lines, and the selection of the points at which they are fastened to the boom, the system control line as adjusting means to place the sail control system in raised or lowered position, and the securing means to hold said sail control system secured along the boom, so that the sail control system can be quickly and easily adjusted to a raised or lowered position by means of the system control line, and the sail control system in the lowered position can be held along the boom, by the securing means, out of the way of the sail and without interfering with covering the sail.

9. The sail control system of claim 8 wherein the lines are selected from the group consisting of braided polyester, braided nylon, 3-strand polyester, and 3-strand nylon.

10. The sail control system of claim 8 wherein the sliding contact means are selected from the group consisting of rings, pulleys or eyes formed in the ends of the lines, with thimbles set therein, or combinations thereof.

11. The sail control system of claim 8 wherein the predetermined lengths of the sail restraining lines and their points of attachment to the boom are so regulated that when the sail control system is in the lowered position extended toward the mast along the boom, the sliding contact means are grouped at the forward end of the boom, and separated from each other by approximately 1 inch to 24 inches.

12. The sail control system of claim 8, further including extension to the cockpit of the boat of the system control line to afford control means from that point.

13. A sail control system for use with a boat having a mast, a boom, and-a sail slidably supported on said mast so that said sail can be lowered to rest on said boom, said sail control system being an improved lazy jack intended to keep the lowered sail confined on the boom, and comprising, on each side of the boom;

a first sail restraining line, attached at each of its ends to separated points along the length of the boom, said first sail restraining line being of such predetermined length and having its points of attachment so located that when it is in a raised position it forms a restraining means for the lowered sail on the boom, and when it is in a lowered position and stretched out along the boom toward the mast its bight cannot reach the mast;

a second sail restraining line, attached at one of its ends to a point on the boom farther from the mast than either attachment point of the first sail restraining line, and having at its other end a sliding contact means, said sliding contact means forming a slidable supporting link for the fir, st sail restraining line, said second sail restraining line being of such predetermined length and having its point of attachment to the boom so located that when it is in a raised position, it forms a slidable supporting link for the first sail restraining line and forms a restraining means to hold the lowered sail on the boom, and when it is in a lowered position and stretched out along the boom toward the mast, its bight falls between the bight of the first sail restraining line and the mast; and a system control line having a sliding contact means at one of its ends, said sliding contact means forming a slidable supporting link for the second sail restraining line, said system control line itself being fed through and supported by a block attached to an elevated point above the boom, with the-other end of the system control line terminated at a suitable control point; and a securing means for holding the sail restraining lines in the lowered position along the boom;

whereby the sail control system may be placed in a raised or lowered position by means of the system control line, and whereby the system control line in a raised position is a support means for the linked first and second sail restraining lines simultaneously to form a control system for the lowered sail, and whereby when the sail control system is in the lowered position, the sail restraining lines can be extended toward the mast and held tautly along the boom by the securing means, out of the way of the sail;

wherein the improvement comprises the predetermined lengths of the sail restraining lines, and the selection of the points at which they are fastened to the boom, the system control line as adjusting means to place the sail control system in raised or lowered position, and the securing means to hold said sail control system secured along the boom, so that the sail control system can be quickly and easily adjusted to a raised or lowered position by means of the system control line, and the sail control system in the lowered position can be held along the boom, by the securing means, out of the way of the sail and without interfering with covering the sail.

14. The sail control system of claim 13 wherein the lines are selected from the group consisting of braided polyester, braided nylon, 3-strand nylon and 3-strand polyester.

15. The sail control system of claim 13 wherein the sliding contact means are selected from the group consisting of rings, pulleys or eyes formed in the ends of the lines, with thimbles set therein, or combinations thereof.

16. The sail control system of claim 13 wherein the predetermined lengths of the sail restraining lines and their points of attachment to the boom are so regulated that when the sail control system is in the lowered position extended toward the mast along the boom, the sliding contact means are grouped at the forward end of the boom, and separated from each other by approximately 1 inch to 24 inches.

17. The sail control system of claim 13, further including extension to the cockpit of the boat of the system control line to afford control means from that point.

18. A sail control system for use with a boat having a mast, a boom, and a sail slidably supported on said mast so that said sail can be lowered to rest on said boom, said sail control system being an improved lazy jack, intended to keep the lowered sail confined on the boom, and comprising, on each side of the boom:

a single sail restraining line attached at each of its ends to separated points along the length of the boom, said single sail restraining line being of such predetermined length and having its points of attachment so located that when it is in a raised position it forms a restraining means for the lowered sail on the boom, and when it is in a lowered position and stretched out along the boom toward the mast, its bight cannot reach the mast;

a system control line having a sliding contact means at one of its ends, said sliding contact means forming a slidable supporting link for the single sail restraining line, said system control line itself being fed through and supported by a block attached to an elevated point above the boom, with the other end of the system control line terminated at a suitable control point; and a securing means for holding the single sail restraining line in the lowered position along the boom;

whereby the sail control system may be placed in a raised or lowered position by means of the system control line, and whereby the system control line in a raised position is a support means for the sail restraining line to form a control system for the lowered sail, and whereby when the sail control system is in the lowered position, said sail restraining line can be extended toward the mast and held tautly along the boom by said securing means, out of the way of the sail;

wherein the improvement comprises the predetermined length of the sail restraining line, and the selection of the points at which it is fastened to the boom, the system control line as adjusting means to place the sail control system in raised or lowered position, and the securing means to hold said sail control system secured along the boom, so that the sail control system can be quickly and easily adjusted to a raised or lowered position by means of the system control line, and the sail control system in the lowered position can be held along the boom, by the securing means, out of the way of the sail and without interfering with covering the sail.

19. The sail control system of claim 18 wherein the block holding each system control line is a cheek block located on the mast at a point approximately one-fourth to three-fourths of its height.

20. The sail control system of claim 18 wherein the sliding contact means are selected from the group consisting of rings, pulleys, or eyes formed in the ends of the lines, with thimbles set therein.

* * * * *